US008104461B2

(12) United States Patent
Kempf

(10) Patent No.: US 8,104,461 B2
(45) Date of Patent: Jan. 31, 2012

(54) CROSSBOW COCKING ASSEMBLY

(76) Inventor: James J. Kempf, Coralville, IA (US)

( * ) Notice: Subject to any disclaimer, the term of this patent is extended or adjusted under 35 U.S.C. 154(b) by 1263 days.

(21) Appl. No.: 11/656,845

(22) Filed: Jan. 23, 2007

(65) Prior Publication Data

US 2010/0269807 A1 Oct. 28, 2010

(51) Int. Cl.
*F41B 5/12* (2006.01)

(52) U.S. Cl. ..... 124/25

(58) Field of Classification Search ..... 124/25
See application file for complete search history.

(56) References Cited

U.S. PATENT DOCUMENTS

| | | | | |
|---|---|---|---|---|
| 2,100,317 | A | 11/1937 | Hickman | |
| 2,957,470 | A | 10/1960 | Barna | |
| 3,238,935 | A | 3/1966 | Stanaland | |
| 3,515,113 | A | 6/1970 | Lawrence | |
| 4,722,317 | A | 2/1988 | Hartwig | |
| 4,766,874 | A | 8/1988 | Nishioka | |
| 4,879,987 | A | 11/1989 | Nishioka | |
| 4,926,834 | A | 5/1990 | Chauvin | |
| 4,976,250 | A | 12/1990 | Jeffrey | |
| 5,115,795 | A * | 5/1992 | Farris | 124/86 |
| 5,368,006 | A | 11/1994 | McPherson | |
| 5,630,405 | A | 5/1997 | Nizov | |
| 6,155,243 | A | 12/2000 | Gallops, Jr. | |
| 6,267,108 | B1 | 7/2001 | McPherson et al. | |
| 6,286,496 | B1 * | 9/2001 | Bednar | 124/25 |
| 6,460,528 | B1 | 10/2002 | Gallops, Jr. | |
| 6,874,491 | B2 * | 4/2005 | Bednar | 124/25 |

* cited by examiner

*Primary Examiner* — John Ricci
(74) *Attorney, Agent, or Firm* — Brett Trout

(57) ABSTRACT

A crossbow with an improved cocking assembly. The improvement includes a means for automatically disengaging a hook associated with a cocking assembly from a bowstring once the bowstring has been drawn the desired distance behind a bowstring retainer. The automatic disengagement of the hook from the bowstring reduces movement and sound associated with disengagement, and reduces the likelihood of injury associated with placement of the fingers in front of the cocked bowstring. The disengagement mechanism may either be mechanical or magnetic as desired.

20 Claims, 12 Drawing Sheets

CROSSBOW COCKING ASSEMBLY

BACKGROUND OF THE INVENTION

1. Field of the Invention

The present invention relates in general to an improved cocking assembly and, more particularly, to an improved cocking assembly for a crossbow.

2. Description of the Prior Art

Crossbows have been known for centuries. By allowing the shooter to mechanically retain the bow in a cocked position, the shooter is provided an advantage over a traditional archer who must utilize muscular force to retain the bow in the cocked position. In a typical crossbow assembly, a cocking mechanism is utilized whereby two hooks are applied to the bowstring to draw the bowstring rearward into engagement with a retainer pin or other device utilized to retain the bowstring in the cocked position until the trigger is pulled. It is also known in the art to provide a crossbow with a cocking mechanism utilizing a single hook as described more fully in United States Letters Patent Application No. 11/029,879, which is incorporated herein by reference.

Whether the cocking mechanism utilizes a single hook or a plurality of hooks, the user typically winds or otherwise engages the cocking mechanism to pull the hooks rearward as they engage the bowstring. Once the bowstring has been pulled to the desired powerstroke, a retainer is either manually or automatically positioned in the path of the bowstring. The cocking mechanism is thereafter released or reversed to move the bowstring into contact with the retainer. Once the bowstring is in contact with the retainer, the user disengages the hook of the cocking mechanism from the bowstring and moves the hook out of the path of the bowstring.

While manual movement of the hook out of engagement with the bowstring moves the hook out of the line of fire of the bowstring, the additional movement required for such an action is time consuming and often places the user's fingers in the path of the bowstring. If the crossbow were inadvertently fired at this time, injury could occur to the user's fingers. An additional drawback associated with the prior art is the noise and movement required to disengage the hook from the bowstring. In many situations, it would be desirable to reduce noise and movement to avoid scaring away game which may be in the area.

The difficulties encountered in the prior art discussed hereinabove are substantially eliminated by the present invention.

SUMMARY OF THE INVENTION

In an advantage provided by this invention, a crossbow is provided with an improved cocking assembly which is of a low-cost, simple manufacture.

Advantageously, this invention provides a crossbow with an improved cocking assembly which allows for quiet release of the cocking assembly from the bowstring.

Advantageously, this invention provides a crossbow with an improved cocking assembly which reduces movement required to release a cocking assembly from a bowstring.

Advantageously, this invention provides a crossbow with an improved cocking assembly of a lightweight, low-cost manufacture.

Advantageously, this invention provides a crossbow with an improved cocking assembly with improved safety characteristics.

Advantageously, in the preferred embodiment of this invention, a crossbow is provided with a frame, a bow and a string provided on the bow. Means are provided for engaging and drawing the string. Means are also provided for retaining the string, as are means for moving the engaging means out of engagement with the string after the string engages the retaining means.

BRIEF DESCRIPTION OF THE DRAWINGS

The present invention will now be described, by way of example, with reference to the accompanying drawings in which:

FIG. 6 illustrates a top perspective view in partial phantom of the improved bow of FIG. 5;

FIG. 9 illustrates a side elevation in cross-section of the alternative embodiment of the improved crossbow of FIG. 8, shown with the hook rotating the string retainer.

DETAILED DESCRIPTION OF THE PREFERRED EMBODIMENT

Figure 1:
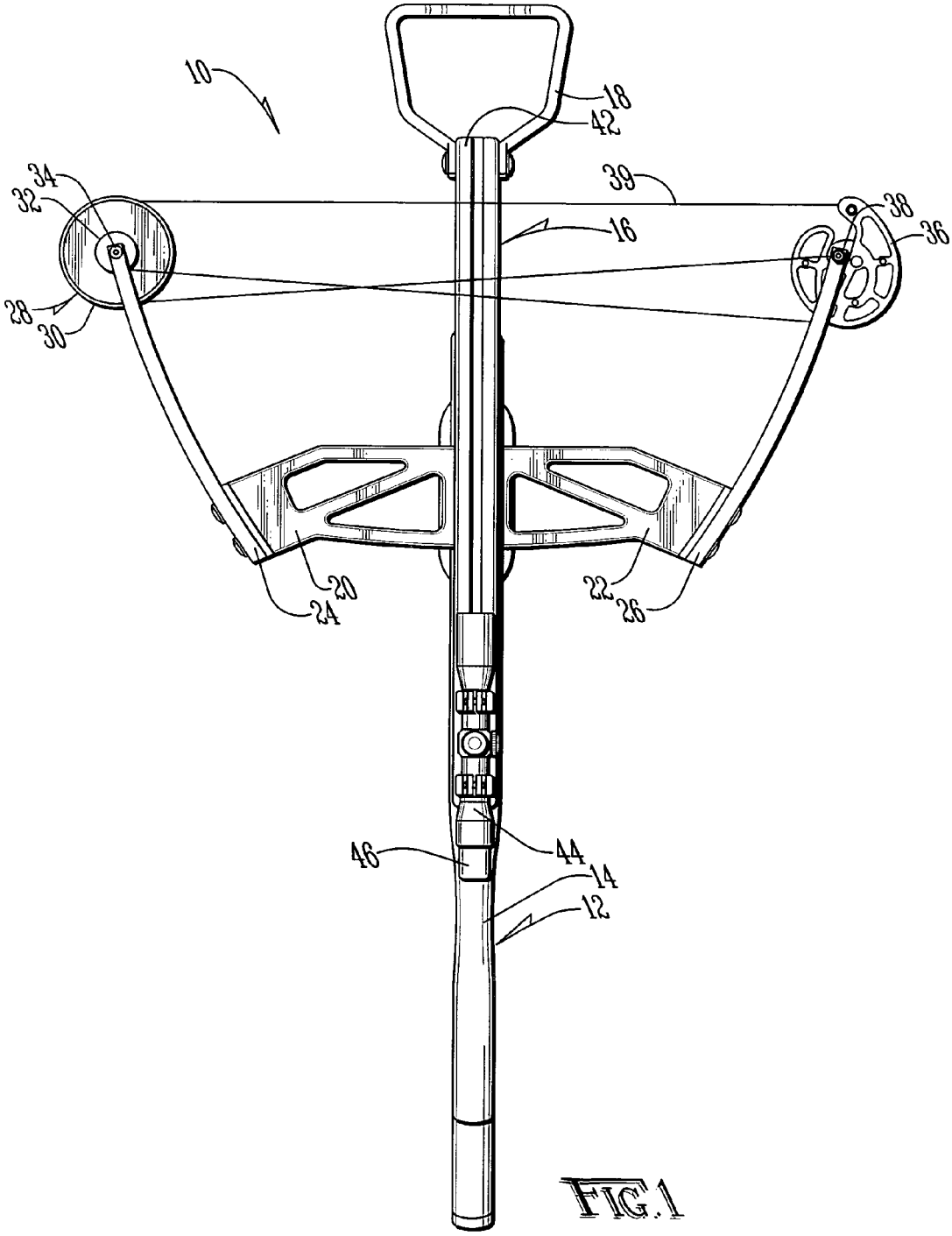
FIG. 1 illustrates a top plan view of the improved crossbow of the present invention shown in the uncocked position.
Figure 2:
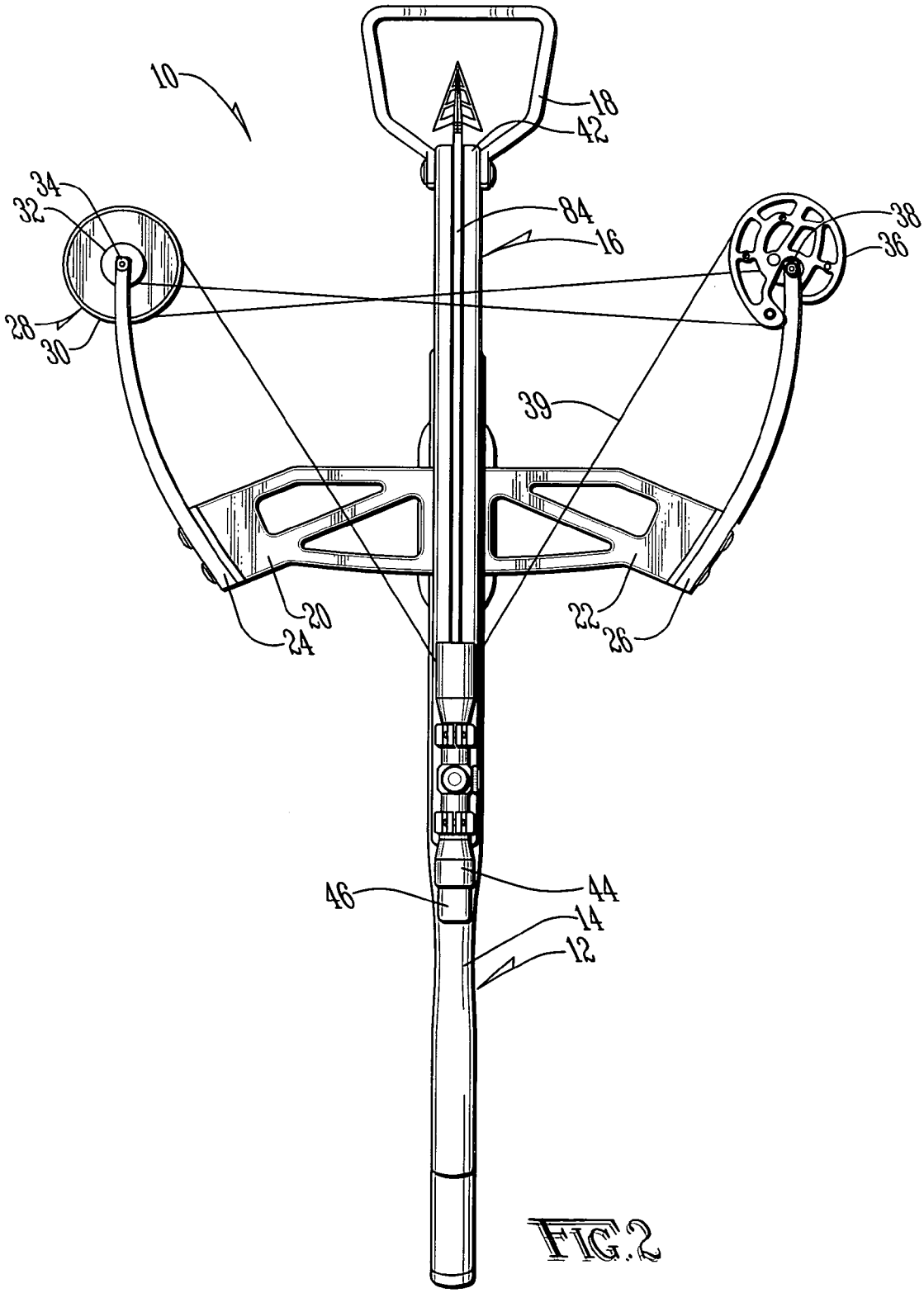
FIG. 2 illustrates the improved crossbow of FIG. 1, shown in the cocked position with a bolt positioned on the rail.

A crossbow according to the present invention is shown generally as (10) in FIG. 1. As shown in FIGS. 1 and 2, the crossbow (10) is provided with a frame (12) which includes a stock (14) and a rail (16). Although the stock (14) and rail (16) may be of any type known in the art, in the preferred embodiment the stock (14) is of a composite material construction, and the rail (16) is constructed of aluminum. Alternatively, the crossbow (10) may be of a "railless" design, such as those known in the art.

Figure 3:
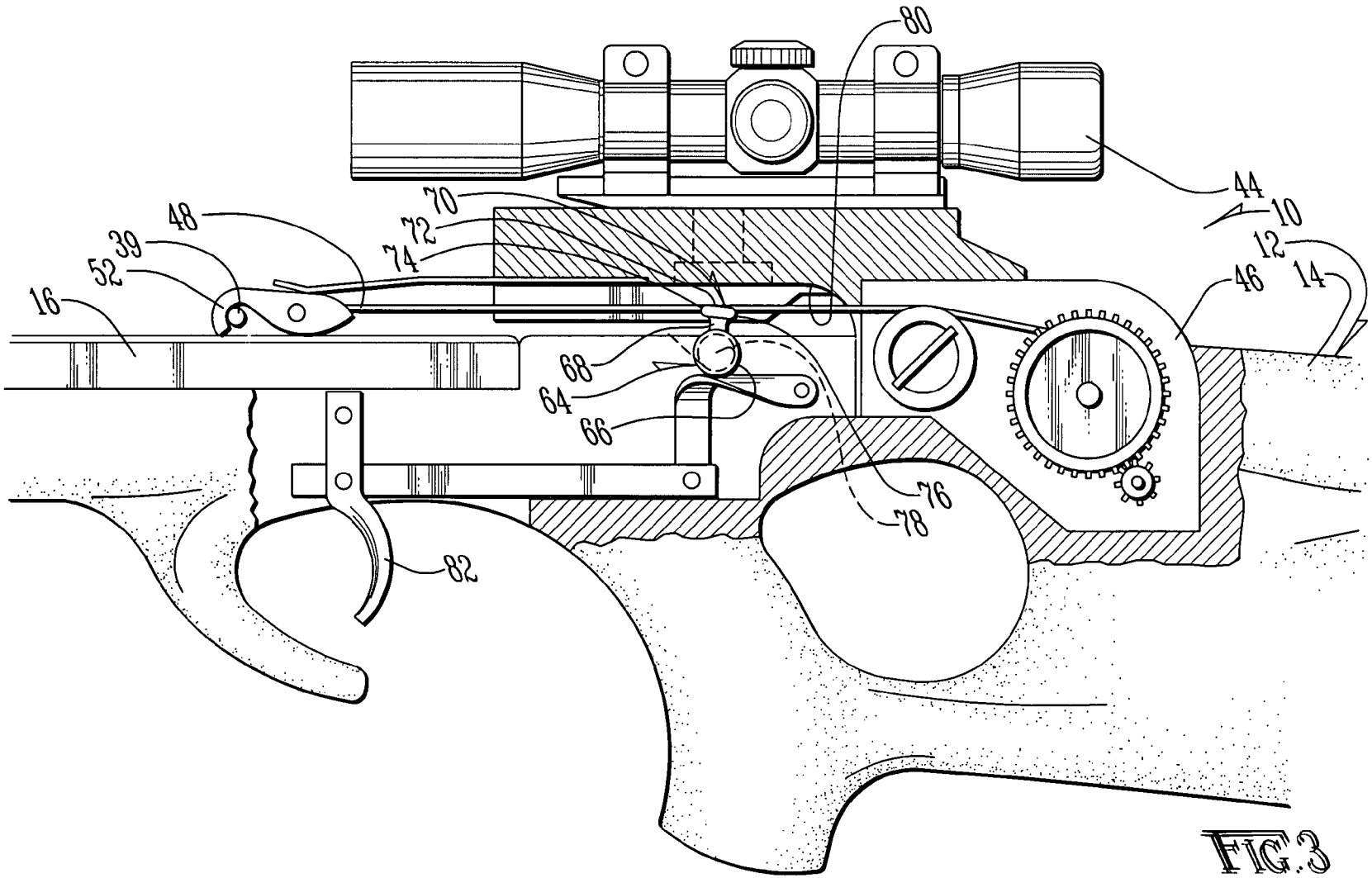
FIG. 3 illustrates a side elevation in cross-section of the improved crossbow as the crossbow is being cocked.

The crossbow (10) is provided with a pivotable foot stirrup (18) to facilitate cocking of the crossbow (10). As shown in FIG. 1, the crossbow (10) is also provided with a pair of risers (20) and (22) secured to the rail (16). The risers (20) and (22) are preferably constructed of aluminum to reduce weight. Coupled to the risers (20) and (22) are limbs (24) and (26). The limbs (24) and (26) are constructed and coupled to the risers (20) and (22) in a manner such as that known in the art. Coupled to the first limb (24) is a first string guide, which in the preferred embodiment is a pulley (28), having an outer track (30) and an inner track (32). The pulley (28) is preferably journaled to the end of the limb (24) by an axle (34). The pulley (28) is preferably journaled to the limb (24) in a manner which positions a portion of the pulley (28) forward and outward of the space defined between the limbs (24) and (26). As shown in FIG. 1, a second string guide, which in the preferred embodiment is a cam (36), is journaled to the second limb (26) by an axle (38). The cam (36) is also journaled to the second limb (26) so that at least a portion of the cam (36) extends forward and outward of the area defined between the limbs (24) and (26). The cam (36) is preferably constructed as shown in FIG. 3, but may be constructed in a manner known in the art.

If desired, two synchronized cams (not shown) may be used in place of the cam (36) and pulley (28). The cam (36) and pulley (28) may be coupled to a bowstring (38) and, if desired, one or more cables in any manner known in the art, but the bowstring (38) is preferably located, as shown in FIG. 1, forward of the points on the limbs (24) and (26) where the cam (36) and pulley (28) are journaled to the limbs (24) and (26).

As shown in FIG. 1, the foregoing orientation of the pulley (28), cam (36), cable (40) and bowstring (38) positions the bowstring (38) very close to the forward end (42) of the rail (16). As shown in FIG. 1, secured above the rail (16) is a scope (44). Releasably secured to the stock (14) is a cocker mechanism (46), such as those known in the art. Alternatively, a cocker mechanism may be integrated into the frame (12). Extending from the cocker mechanism (46) is a band (48) pivotably coupled to a hooks (52).

Figure 4:
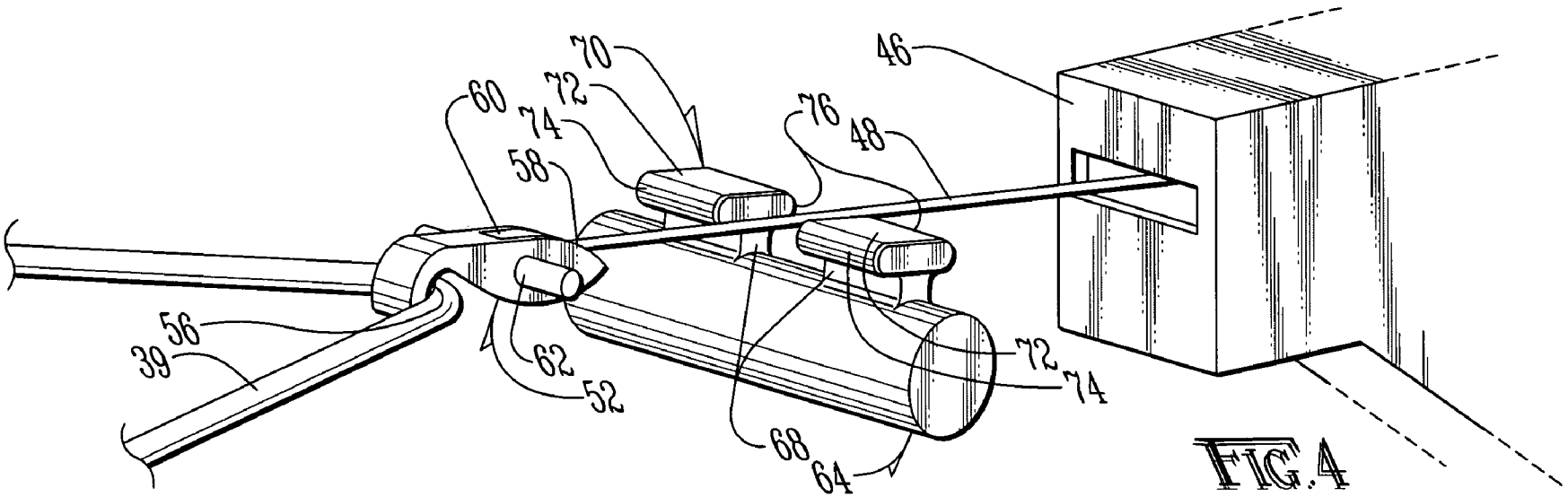
FIG. 4 illustrates a top perspective view of the crossbow of FIG. 3.

As shown in FIG. 4, the hook (52) is provided with a curved catch configured to receive the bowstring (38). The hook (52) is also provided with a curved butt (58). As shown in FIG. 4, the hook (52) is provided with an opening (60). A pin (62) is provided through the hook (52) and extends across the opening (60). The band (48) is pivotably coupled to the pin (62). Alternatively, the band (48) may be secured directly to the pin (62) and the pin (62) journaled to the hook (52). Although the band (48) may be coupled to the hook (52) in any desired configuration, preferably the hook (52) is configured so as to be pivotably rotatable relative to the band (48). The pin (62) extends beyond either side of the hook (52) to allow the pin (62) to be more easily grasped when it is desired to extend the hook (52) from the cocker mechanism (46).

Figure 5:
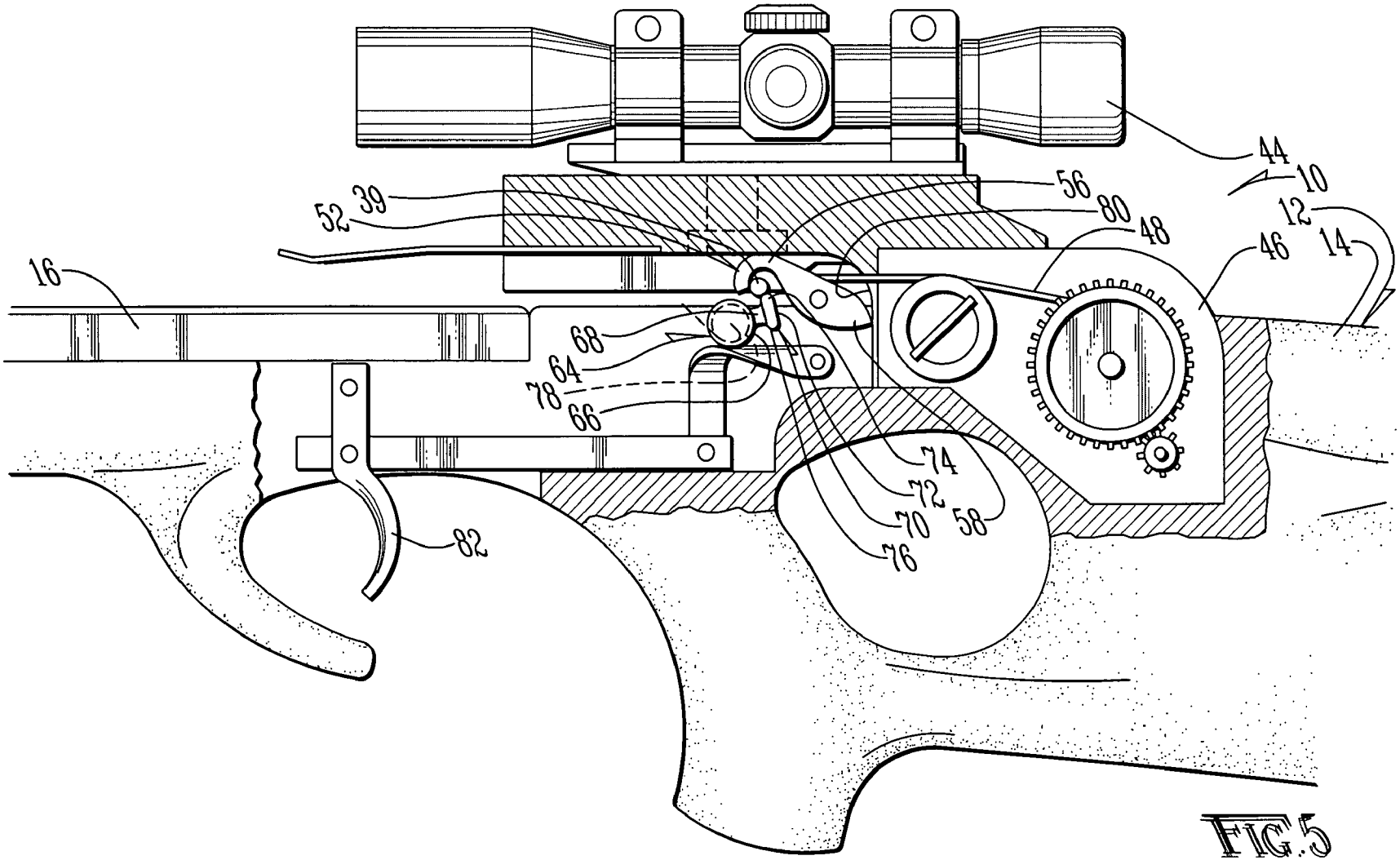
FIG. 5 illustrates a side elevation in cross-section of the improved crossbow, shown with the hook rotating the string retainers as the bowstring is drawn.

As shown in FIGS. 3 and 4, when it is desired to cock the crossbow (10), the hook (52) is extended from the cocker mechanism (46) and provided over the bowstring (38). The cocker mechanism (46) is then actuated to draw the band (48), hook (52) and bowstring (38) rearward. As shown in FIGS. 5 and 6, as the hook (52) moves rearward, the bowstring (38) contacts pivoting retainer (64). As shown in FIG. 5, the retainer (64) is pivotally secured to the frame (12) of the crossbow (10) by any desired means. The retainer (64) is preferably provided with two necks (68) integrally formed with two heads (70). The heads (70) are provided with flat tops (72), cantilevered front shoulders (74) and cantilevered rear shoulders (76). The heads (70) are preferably biased toward the upright position shown in FIGS. 3-4 by a torsion spring (78) or the like.

As shown in FIG. 5, as the bowstring (38) contacts the front shoulders (74) of the retainer (64), additional pulling force from the cocker (46) causes the bowstring (38) to rotate the head (70) of the retainer (64) rearward. Simultaneously, the butt (58) of the hook (52) contacts an arcuate track (80) formed of steel or the like and secured to the frame (12) of the crossbow (10). The curvature of the track (80) and the curvature of the butt (58) of the hook (52) coact to pivot the hook (52) relative to the band (48) as the hook (52) continues to move rearward. As the hook (52) continues to move rearward, the catch (56) of the hook (52) begins to lift from the bowstring (38).

Figure 7:
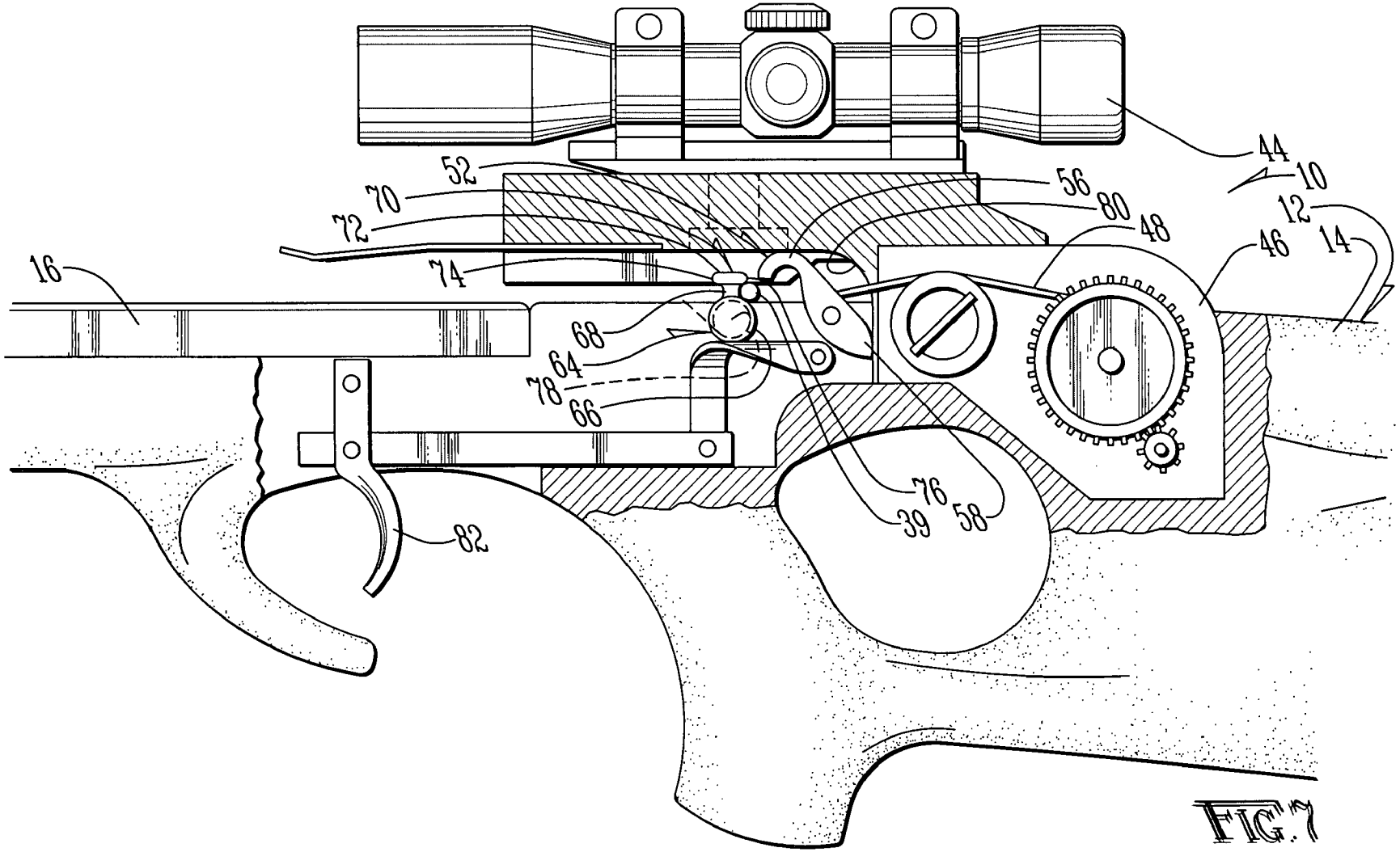
FIG. 7 illustrates a side elevation in cross-section of the improved crossbow, shown with the hook fully rotated and the string retained by the string retainers.
Figure 8:
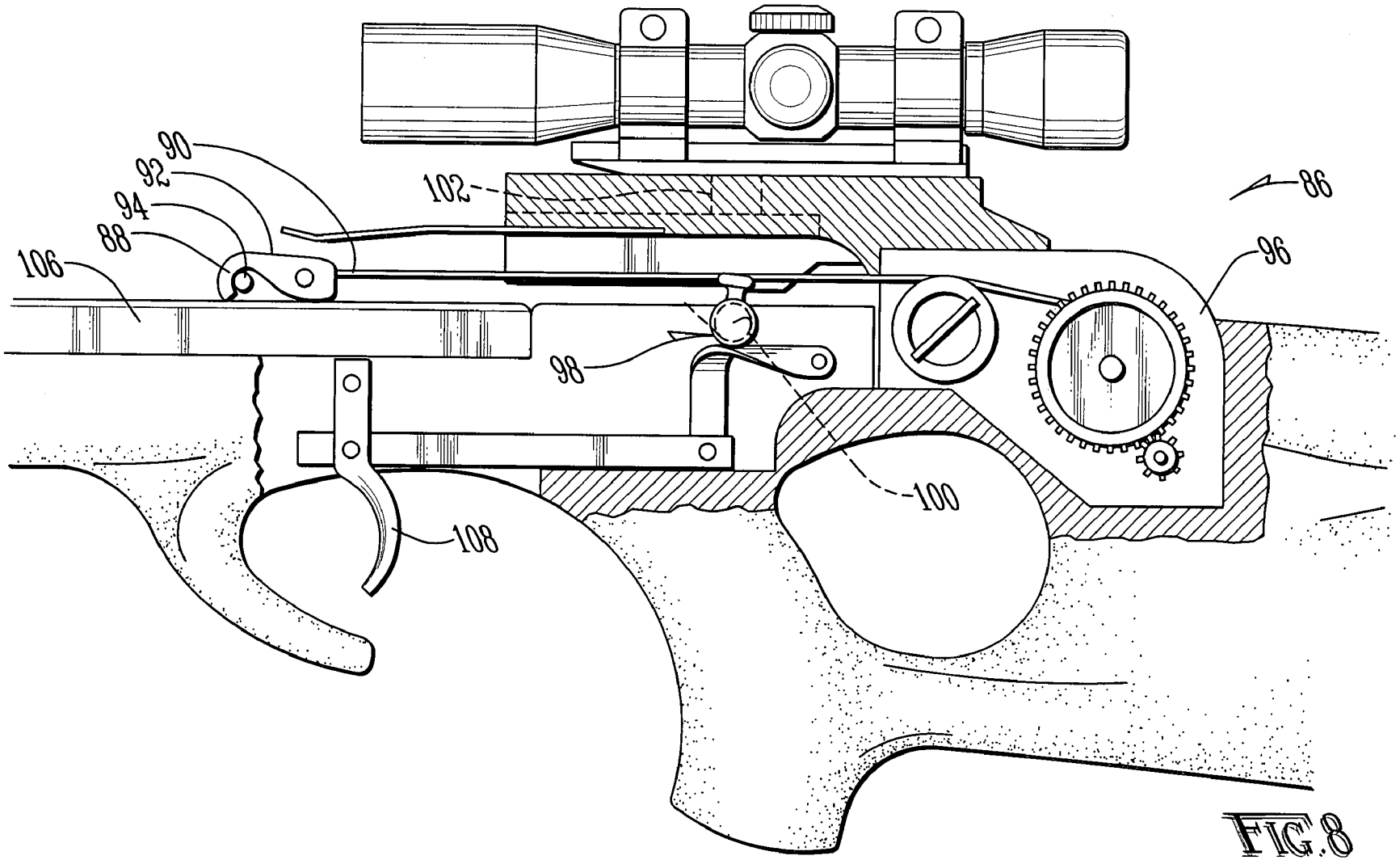
Figure 8:
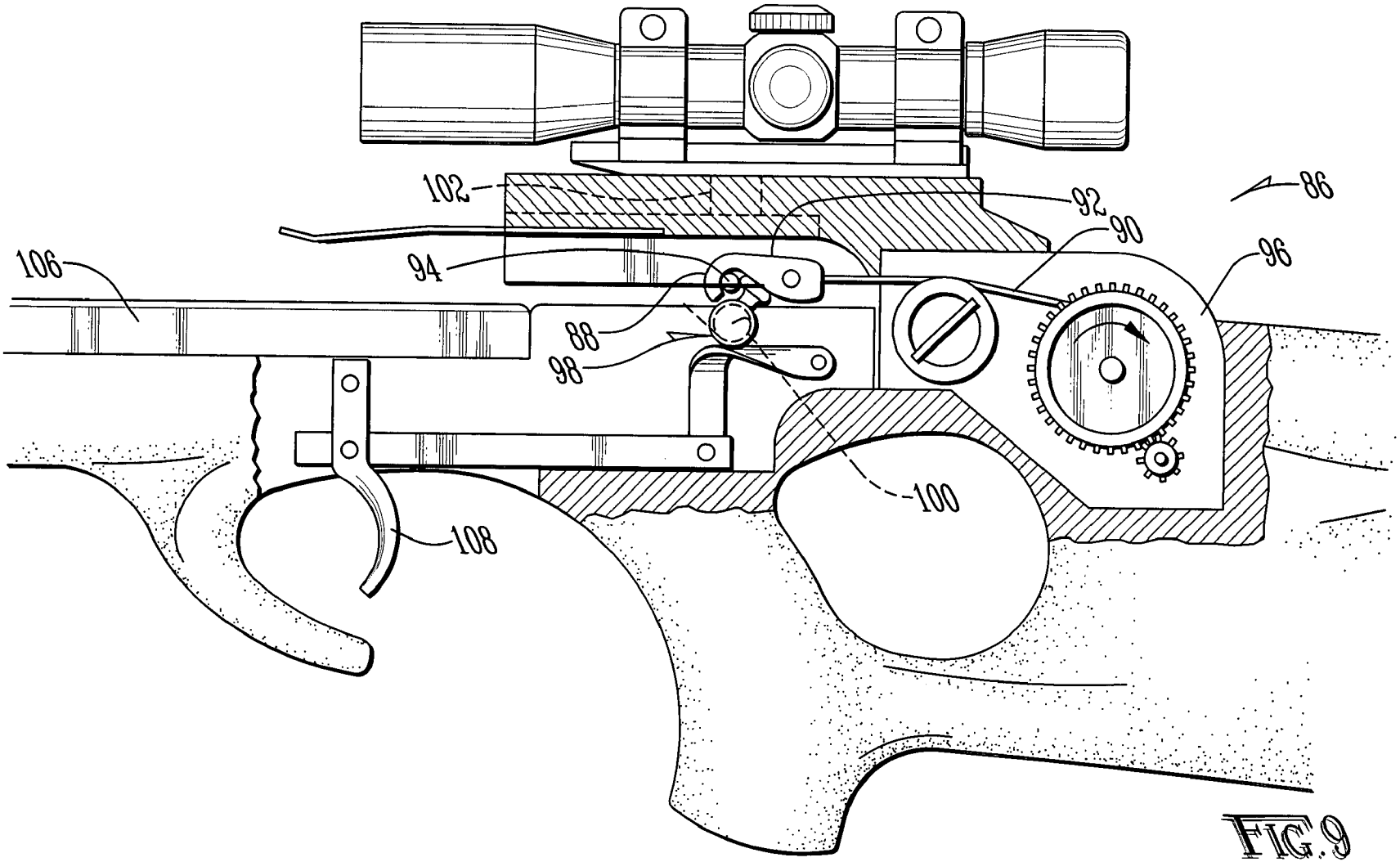

As shown in FIG. 7, once the hook (52) has caused the bowstring (38) to pass the heads (70) of the retainer (64), the torsion spring (78) biases the retainer (64) back to its upright position as the curvature of the track (80) and hook (52) cause the catch (56) of the hook (52) to release the bowstring (38). Once the bowstring (38) is free, the bowstring (38) presses against the rear shoulders (76) of the retainer (64). The cantilevered configuration of the rear shoulders (76) prevents the bowstring (38) from moving upward and over the head (70) of the retainer (64) before the trigger (82) is actuated. The retainer (64) may be coupled to the trigger (82) in any desired configuration, including any additional number of safety features known in the art. When it is desired to fire the crossbow (10), an arrow (84), or any desired projectile known in the art, is placed on the rail (16) and the safety features, if any, are disengaged. The trigger (82) is then actuated, causing the retainer (64) to quickly rotate forward, releasing the bowstring (38) and causing the bowstring (38) to rapidly propel the arrow (84) down the rail (16).

Figure 8:
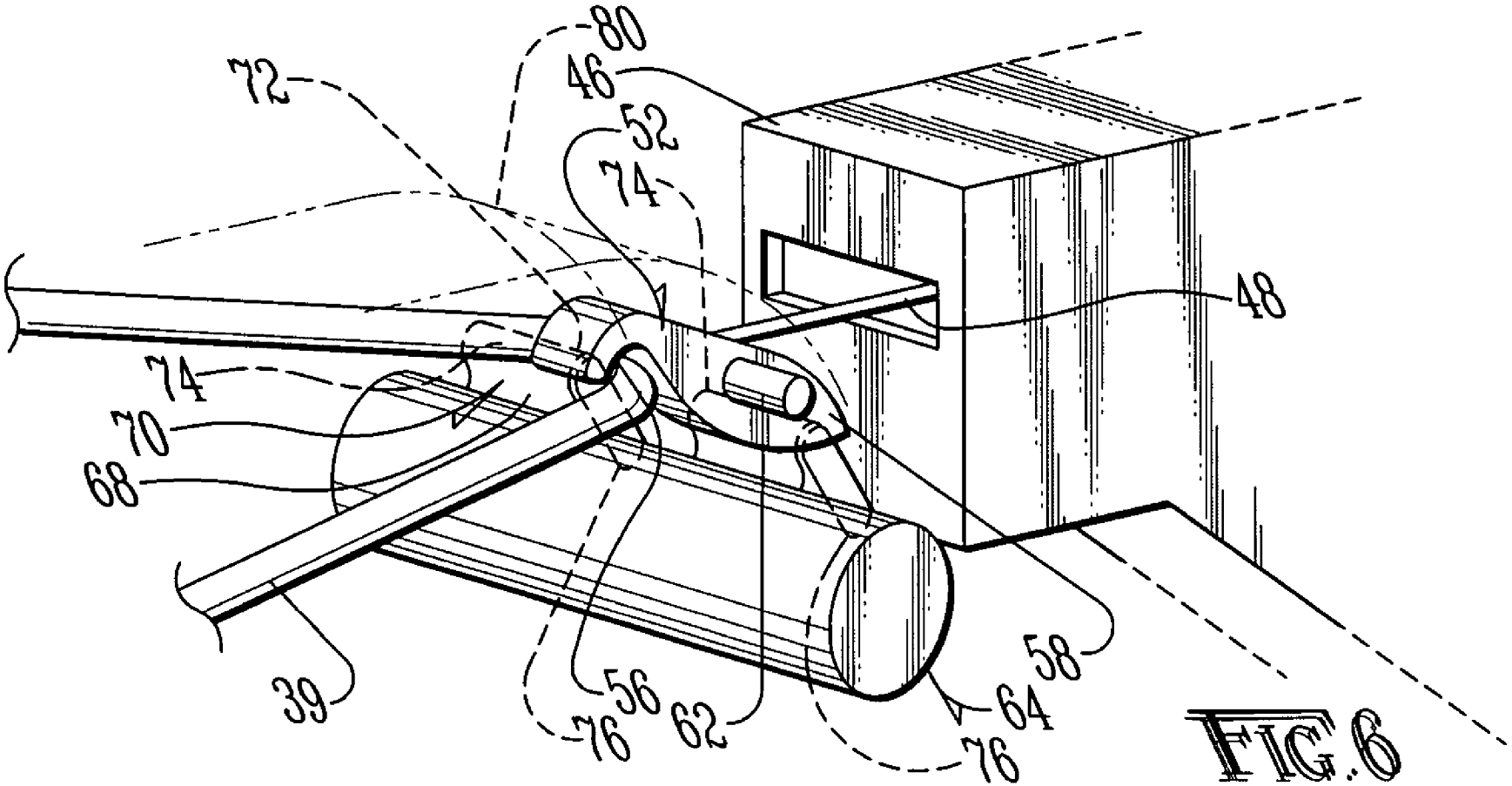
FIG. 8 illustrates a side elevation in cross-section of an alternative embodiment of the improved crossbow as the bowstring is being drawn.

An alternative embodiment of the present invention is shown generally as (86) in FIG. 8. As shown in FIG. 8, the hook (88) is secured to the band (90) by any desired means. In this embodiment, the hook (88) is preferably provided with a long, flat top (92) and is constructed of a ferrous material. As shown in FIG. 9, as the cocker draws the band (90) rearward, the hook (88) causes the bowstring (94) to rotate the retainer (64).

Figure 10:
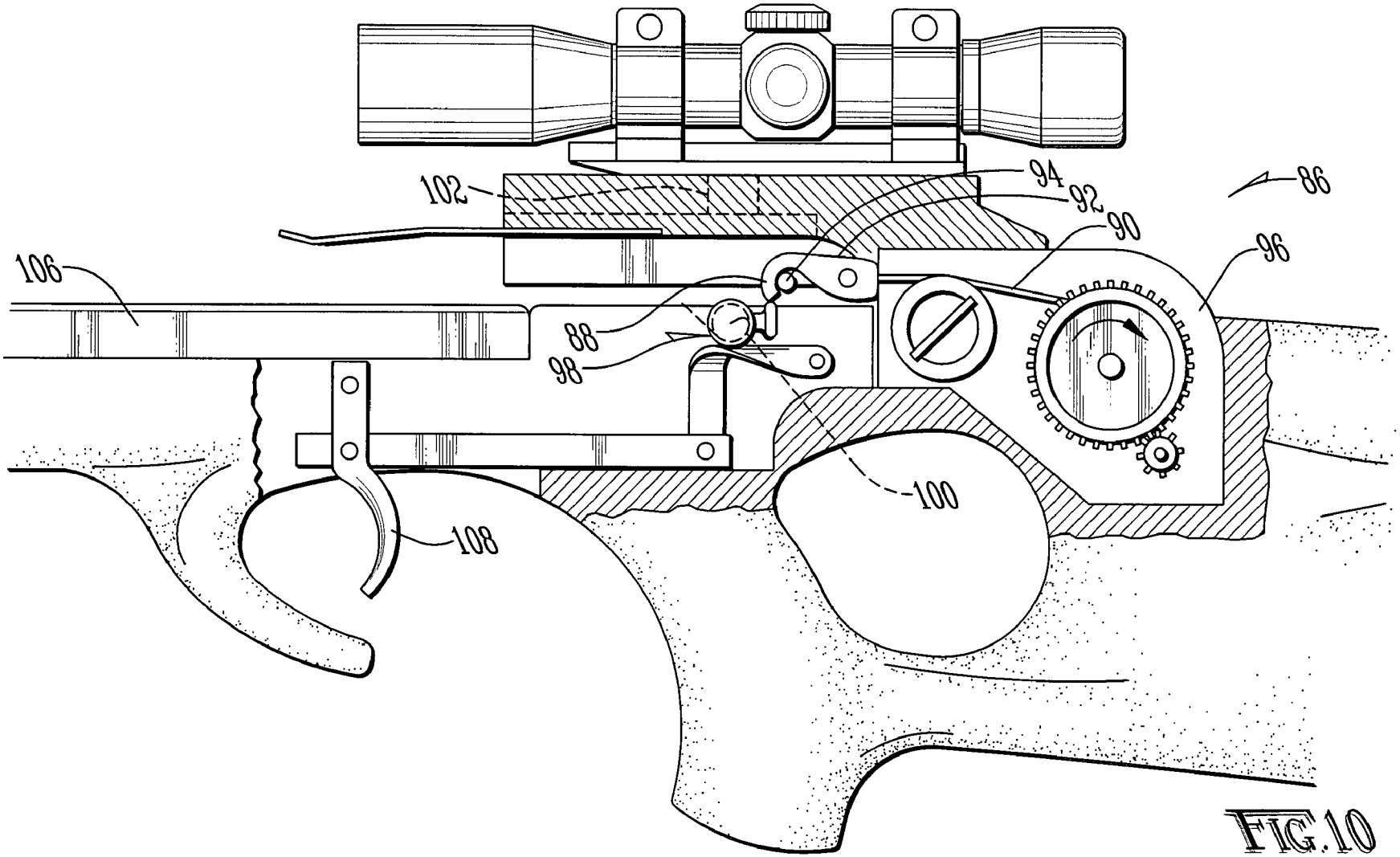
FIG. 10 illustrates a side elevation in cross-section of the alternative embodiment of the improved crossbow of FIG. 8, shown with the retainer fully rotated.
Figure 11:
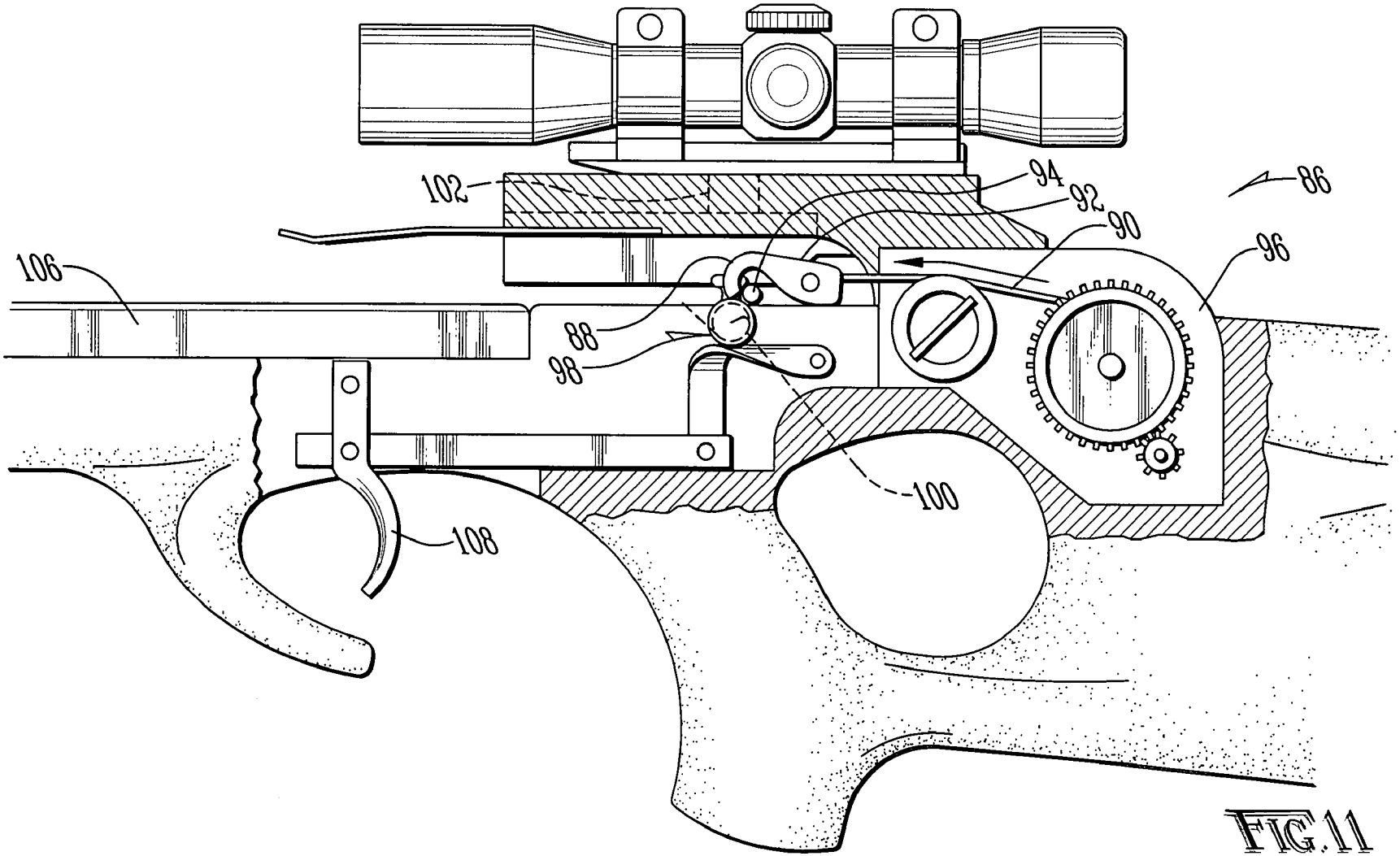
FIG. 11 illustrates a side elevation in cross-section of the alternative embodiment of the improved crossbow of FIG. 8, shown with the string retained by the string retainers, and the rearward force on the hook being released.
Figure 12:
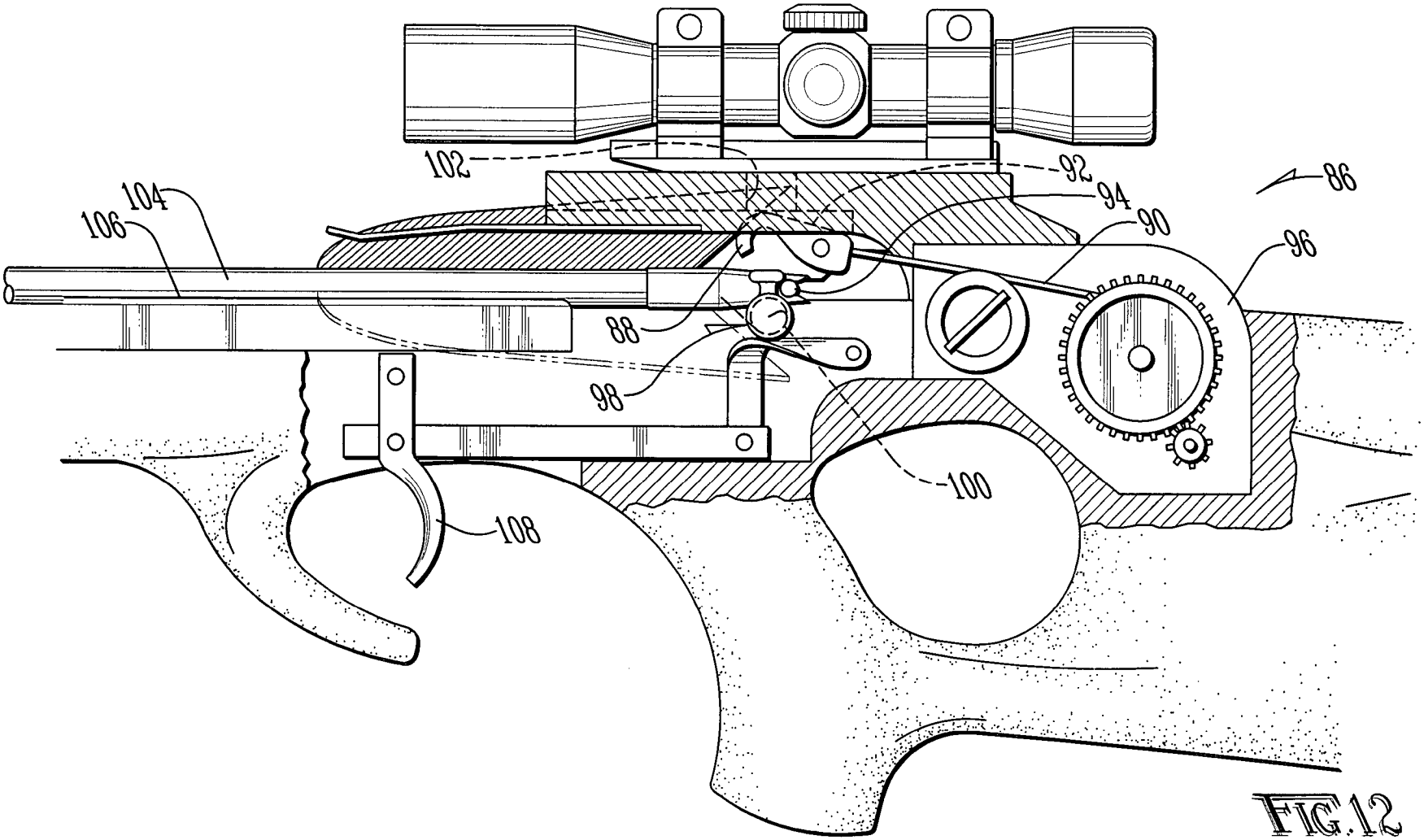
FIG. 12 illustrates a side elevation in cross-section of the alternative embodiment of the improved crossbow of FIG. 8, shown with the string engaged with the string retainers and the hook drawn out of the line of fire by a magnet.

As shown in FIG. 10, once the cocker (96) draws the hook (88) over the retainer (98), the retainer (98) pivots on the torsion spring (100) as described above. As shown in FIG. 11, once the bowstring (94) has been pulled behind the retainer (98), the torsion spring (100) biases the retainer (98) into the original position. Thereafter, the cocker (96) is reversed. The bowstring (94) biases the hook (88) forward until the bowstring (94) contacts the retainer (98). As shown in FIG. 11, as the hook (88) move forward, a magnet (102), preferably a neodymium-iron-boron magnet, or similarly powerful magnet, draws the hook (88) upward and out of the line of fire of the bowstring (94). Thereafter, an arrow (104) is positioned on the rail (106). Once all of the safety devices have been disengaged, the trigger (108) is actuated to release the retainer (98), causing the bowstring (94) to drive the arrow (104) down the rail (106). When it is desired to reload the alternative embodiment of the crossbow (86), the cocker (96) can be used to draw the hook (88) rearward to slide the hook (88) relative to the rare earth magnet (102) to release the hook (88) therefrom. Alternatively, the hook (88) may be engaged by the user and slid forwardly relative to the rare earth magnet (102) to release the hook (88) therefrom.

Although the invention has been described with respect to a preferred embodiment thereof, it also to be understood it is not to be so limited, since changes and modifications can be made therein which are within the full, intended scope of this invention as defined by the appended claims. For example, the improved cocking assembly of the present invention can be used in association with any size crossbow from small hand-held versions to large vehicle mounted versions. Additionally, it should be noted that the present invention may be used in association with reverse draw crossbows such as that described above, regular draw crossbows having risers extending rearwardly from the forward end of the crossbow, and may be used in association with any combination of pulleys or cams coupled to the risers. It is additionally anticipated that the invention can be utilized with a single hook and a double retainer as opposed to the double hook and single retainer described above.

What is claimed is:

1. A crossbow comprising:

(a) a frame;

(b) a bow;

(c) a string provided on said bow;

(d) means for engaging said string;

(e) means coupled to said engaging means for drawing said string;

(f) means for retaining said string; and (g) means for moving said engaging means out of engagement with said string after said string engages said retaining means.

2. The crossbow of claim 1, wherein said moving means is means for pivoting said engaging means out of engagement with said string after said string engages said retaining means.

3. The crossbow of claim 2, wherein said engaging means is a hook coupled to a cable.

4. The crossbow of claim 3, further comprising a crank coupled to said cable.

5. The crossbow of claim 1, wherein said moving means is means for magnetically moving said engaging means out of contact with said string in response to a reversal of said crank.

6. The crossbow of claim 1, wherein said retaining means is means for retaining said string at a first point and a second point.

7. The crossbow of claim 6, wherein said engaging means is means for engaging said string at a point between said first point and said second point.

8. The crossbow of claim 1, wherein said moving means is means for magnetically moving said engaging means out of contact with said string.

9. The crossbow of claim 8, wherein said moving means is positioned above said engaging means.

10. A crossbow comprising:

(a) a frame;

(b) a bow;

(c) a string provided on said bow;

(d) a hook coupled to said string;

(e) a cable pivotably coupled to said hook;

(f) means coupled to said cable for drawing said string;

(g) means for retaining said string; and (h) means for pivoting said hook out of engagement with said string after said string engages said retaining means.

11. The crossbow of claim 10, further comprising a crank coupled to said cable.

12. The crossbow of claim 10, wherein said retaining means is means for retaining said string at a first point and a second point.

13. The crossbow of claim 12, wherein said hook is coupled to said string at a point between said first point and said second point.

14. The crossbow of claim 10, wherein said pivoting means is an arcuate block.

15. The crossbow of claim 14, wherein said hook is provided with a tail, wherein said cable is coupled between said hook and said tail.

16. A crossbow comprising:

(a) a frame;

(b) a bow;

(c) a string provided on said bow;

(d) means for engaging said string;

(e) means coupled to said engaging means for drawing said string;

(f) means for retaining said string; and (g) means for magnetically moving said engaging means out of engagement with said string.

17. The crossbow of claim 16, wherein said moving means is a magnet positioned above said string.

18. The crossbow of claim 16, wherein said engaging means is a magnet and wherein said moving means is a ferrous material located above said string.

19. The crossbow of claim 16, wherein said engaging means is a hook and further comprising a cable coupled to said hook.

20. The crossbow of claim 19, further comprising a crank coupled to said cable.

* * * * *